US005370057A

United States Patent [19]

Badura et al.

[11] Patent Number: 5,370,057

[45] Date of Patent: Dec. 6, 1994

[54] MISSILE WITH DETACHABLE DRAG CHUTE

[75] Inventors: Wolfgang Badura; Christian Falter, both of Bad Reichenhall, Germany

[73] Assignee: Buck Werke GmbH & Co., Bad Ueberkingen, Germany

[21] Appl. No.: 181,912

[22] Filed: Jan. 18, 1994

[30] Foreign Application Priority Data

Feb. 3, 1993 [DE] Germany ..... 4303076

[51] Int. Cl.[5] ..... F42B 15/10

[52] U.S. Cl. ..... 102/378; 102/354; 102/377

[58] Field of Search ..... 102/374, 377, 378, 337, 102/339, 340, 348, 354

[56] References Cited

U.S. PATENT DOCUMENTS

| | | | |
|---|---|---|---|
| 3,113,752 | 12/1963 | Brestel | 102/340 |
| 3,867,893 | 2/1975 | Saholt et al. | 102/378 |
| 3,946,672 | 3/1976 | Adams et al. | 102/337 |
| 4,226,185 | 10/1980 | Tobler et al. | 102/340 |
| 4,519,315 | 5/1985 | Arszman | 102/377 |
| 5,103,734 | 4/1992 | Arnaud et al. | 102/377 |

*Primary Examiner*—David Brown

*Attorney, Agent, or Firm*—Hill, Steadman & Simpson

[57] ABSTRACT

A missile includes, as viewed successively in flight direction, a booster, a folded drag chute in a parachute housing, a cruise engine and a warhead. The booster is detachable from the drag chute before the opening of the drag chute and the drag chute is detachable from the cruise engine upon the activation of said cruise engine. The drag chute is accommodated in a parachute housing that is closed toward the booster and is open toward the cruise engine to which the booster is connected via a positive locking releasable due to axial tensile force. A separating charge for detaching the booster from the parachute housing is arranged between the booster and the base of the parachute housing at the booster side. The booster is connected to the parachute housing via a mechanical parachute release mechanism for releasing the drag chute from the parachute housing with a delay in comparison to the ignition of the separating charge.

16 Claims, 5 Drawing Sheets

Pos.
I
II
III
IV
V
18
16
12
10
14

IV
V
III
II
I
24
22
20

MISSILE WITH DETACHABLE DRAG CHUTE

BACKGROUND OF THE INVENTION

1Field of the Invention

The present invention is directed to a missile of the type which, as viewed in the flying direction from back to front, includes a booster, a folded drag parachute in a parachute housing, a cruise engine and a warhead in succession, whereby the booster is detachable from the drag chute before the parachute drag chute opens, and the drag chute can be separated from the cruise engine before the cruise engine is activated.

2. Description of the Prior Art

A missile of this type is disclosed in German Patent Application P 42 10 113.1-15, but there is no discussion therein of the problem of the separation of the various missile elements between firing from the ground position and the active position at the target.

German OS 39 37 762 discloses an artillery projectile having a plurality of munitions payloads, each of which is intended to descend in a target region decelerated by a parachute, whereby the munitions payloads and parachutes are thrust from the stern of a carrier sheath by activating an ignitor after the projectile stern is detached. The parachute of the stern side in the munitions payload unit which is farthest toward the rear as viewed in the flying direction is thereby opened by stretching a ripcord that is firmly joined thereto and to the projectile stern, and decelerates the backmost munitions payload unit relative to the rest of the munitions payload units. When, for example, two munitions payload units are present, a retardation element such as, for example, a centrifugal mass is placed in motion upon the emergence of the munitions payloads from the carrier sheath, this retardation element causing an enable mechanism to release the second parachute after a pre-determined delay time.

German OS 21 44 400 discloses a flare projectile wherein a set of flares as well as a set of delay elements are ignited after the ignition of an ejection charge and a drag chute and a main parachute as well as the set of flares are ejected from a projectile shell at the stern side thereof, so that the drag chute arranged at the stern can freely open in order to somewhat reduce the flight speed of the set of flares. As soon as the set of delay elements ignites a further combustion charge between the set of flares and the main parachute, the gas pressure that thereby builds up drives a pressure plate which releases the connection between the set of flares and the main parachute, so that the weight of the set of flares pulls the main parachute from the packing bag closely surrounding it and the parachute can freely open.

Further, German OS 15 78 193 discloses a flare projectile, wherein combustion gases arising after the firing of an ejector charge accelerate a first shell containing a parachute, a second shell arranged in front of the first shell as seen in the flying direction, and a phosphor. The acceleration is relative to the housing of the flare projectile in the flying direction, whereby the shell of the parachute—by contrast to the shell of the phosphor—cannot emerge from the housing. As soon as the shell of the phosphor leaves the housing, it drags the parachute, whose cords are connected to the base thereof, out of the housing behind it, so that the parachute can freely open in order to serve the purpose of decelerating the phosphor.

SUMMARY OF THE INVENTION

An object of the invention is to improve the missile of the type initially described so that a faultless, functionally necessary separating of the individual missile elements is guaranteed while simultaneously projecting the drag chute against thermal and mechanical stressing.

This object is inventively achieved in a missile the drag chute is accommodated in a parachute housing that is closed toward the booster and open toward the cruise engine, the drag chute being contained in a parachute pot disposed in and having limited axial displaceability within, the parachute housing. The parachute housing is connected to the booster via a positive locking such as a crimping or the like that can be released by axial tensile force. A separating charge for detaching the booster from the parachute housing is arranged between the base of the parachute housing at the booster side and the booster. The booster is connected to the parachute housing via a mechanical parachute release mechanism for releasing the drag chute from the parachute housing that takes effect with a delay in comparison to the igniting of the separating charge. The parachute release mechanism is connected, via a transmission means which imposes the delay, to the base of the parachute pot facing toward the base of the parachute housing at the booster side. Connecting means are provided between the parachute housing and the cruise engine, the connecting means being disengageable by the axial displacement triggered via the parachute release mechanism after the ignition of the separating charge.

The parachute release mechanism may be an arrestor cable connection. The arrestor cable connection may be an arrester cable wound onto a cable drum. The cable drum may be arranged with its circumferential surface parallel to the longitudinal center axis of the missile. The cable drum may be coaxially arranged relative to the longitudinal center axis of the missile.

The separating charge can be accommodated in a separating charge pot that has a base facing toward the parachute housing and which is open toward the booster.

In a further embodiment of the invention, the circumferential surface of the cable drum can concentrically surround the separating charge pot.

The separating charge and the parachute release mechanism can be attached to the parachute housing.

In a further embodiment of the invention, the end of the parachute housing facing away from the cruise engine may have a hollow-cylindrical projection, open toward the booster and concentric relative to the longitudinal center axis of the missile, that surrounds the separating charge and the-parachute release mechanism and that is in turn surrounded by a projection of the jacket of the booster.

In another embodiment of the missile of the invention can also be distinguished in that the connecting means between the parachute housing and the cruise engine device is fashioned as a positive locking.

In a further embodiment, the connecting means may be an essentially L-shaped, resilient connecting ring and an outer circumferential groove of the cruise engine, whereby one leg of the connecting ring - given an axial pressure charging - engages into the outer circumferential groove through the circumferential edge of the parachute pot at the side of the cruise engine and the other leg of the connecting ring engages into an inner annular recess of the parachute housing, this annular recess expanding obliquely outward in a direction toward the booster.

The lines of the drag chute are secured to a cover guided so as to be axially movable within the parachute pot, this cover being connected to the cruise engine via an interlock mechanism so as to be releasable due to the discharge of the cruise engine.

The interlock mechanism may be a resilient strain ring having a first retainer means for the cover and a second retainer means for the cruise engine, the strain ring being pressed radially outwardly into its locking position by a supporting cover that covers a propulsion gas discharge opening of the cruise engine, until an adequate propulsion gas pressure has been built up.

The first retainer means may include a radially outwardly extending, first edge flange of the strain ring that presses against the inside of a front flange of the cover. The cover has an inner circumferential surface which slants obliquely radially inwardly in the direction toward the cruise engine and an outer circumferential surface which is cylindrically accepted in the parachute pot so as to be axial slidable therein.

The second retainer means may include a radially outwardly extending, second edge flange of the strain ring that engages into an inner annular channel of the cruise engine.

The invention is based on the surprising perception that a faultless, functionally suited separation of the individual missile elements in the various function conditions is achieved while simultaneously protecting the drag chute against thermal and mechanical stressing even though detachment of the booster from the remaining missile composed of the parachute housing, the cruise engine and of the warhead ensues on the basis of a hard separation by the action of a separating charge. This is achieved by exercising care to insure that the separating charge cannot come into contact with the sensitive parachute brake, and providing a soft release of the drag chute from the parachute housing by a mechanical coupling device, preferably in the form of an arrestor cable, acting with time delay. Given an unstressed length of approximately 1 meter, a suitable cable (consisting, for example, of Perlon ® nylon). It is also assured that the drag chute is initially protected against the hot propulsion gases of the cruise engine after it is activated, and can only release from the unit formed of the cruise engine and the warhead when a propulsion gas pressure has been built-up by the cruise engine which is adequate for the faultless maneuvering of the warhead, which may be provided with sensor and guide means in a known way.

DESCRIPTION OF THE PREFERRED EMBODIMENTS

Figure 1:
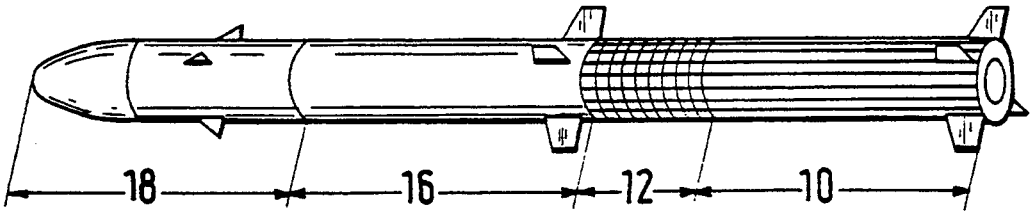
FIG. 1 shows missile of the invention in a perspective side view.

As shown in FIG. 1, the missile in the illustrated exemplary embodiment includes a booster 10 arranged at the stern, includes a parachute section 12 adjoining thereto containing a parachute pot 60 (not visible in FIG. 1) which holds a folded drag chute 14 (FIG. 3 among others), a cruise engine 16 as well as a warhead 18. These stages are arranged following one another in the flying direction (toward the left of FIG. 1).

Figure 2:
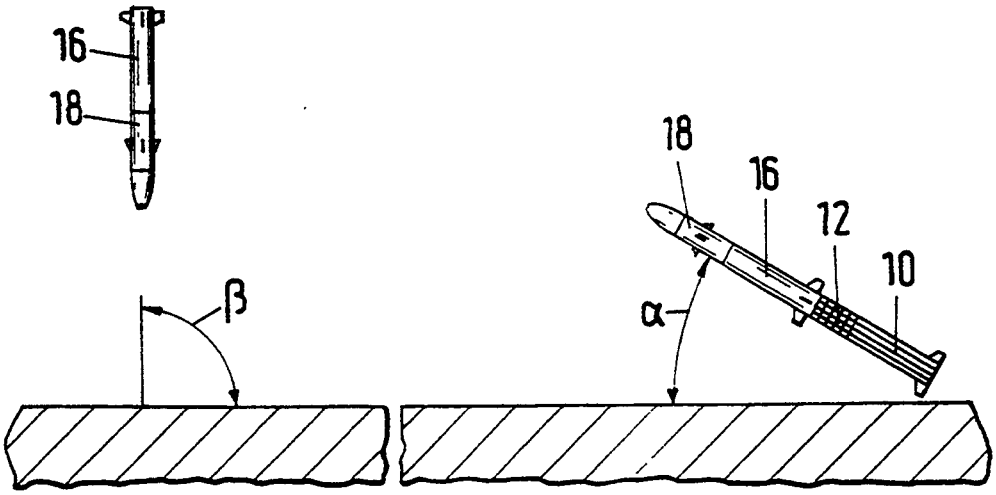
FIG. 2 shows the missile of FIG. 1 in its firing position and in its active position.

The missile is shown in its ground position at the right in FIG. 2. It is fired from its ground position at an exit angle $\alpha$ by actuating the booster (rocket engine) 10. The active position of the missile is then shown farther toward the left in FIG. 2 wherein it is downwardly directed at a directional angle $\beta$ of approximately 90°, i.e. vertically, above the ground with the warhead 18 directed down. In this position, the booster 10 and the parachute section 12 have already been separated from the active unit composed of the cruise engine 16 and of the warhead 18 in the manner set forth below.

Figure 3:
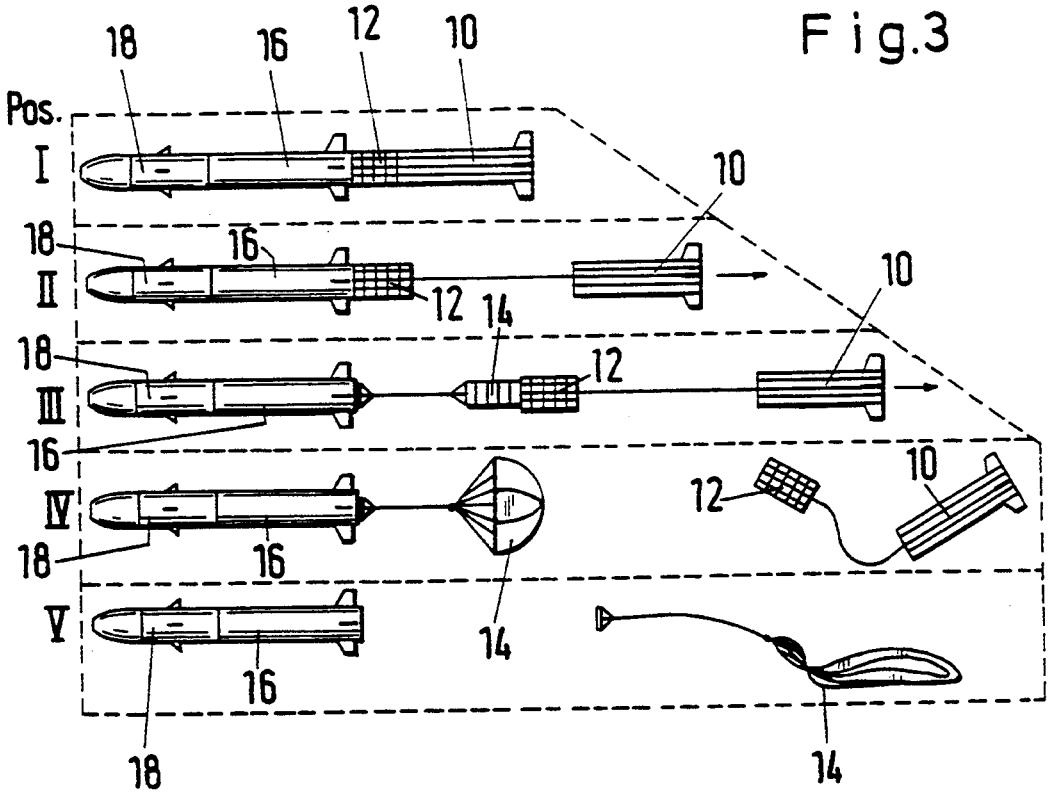
FIG. 3 shows the missile of FIG. 1 and FIG. 2 in various separation stages, in a side view.
Figure 4:
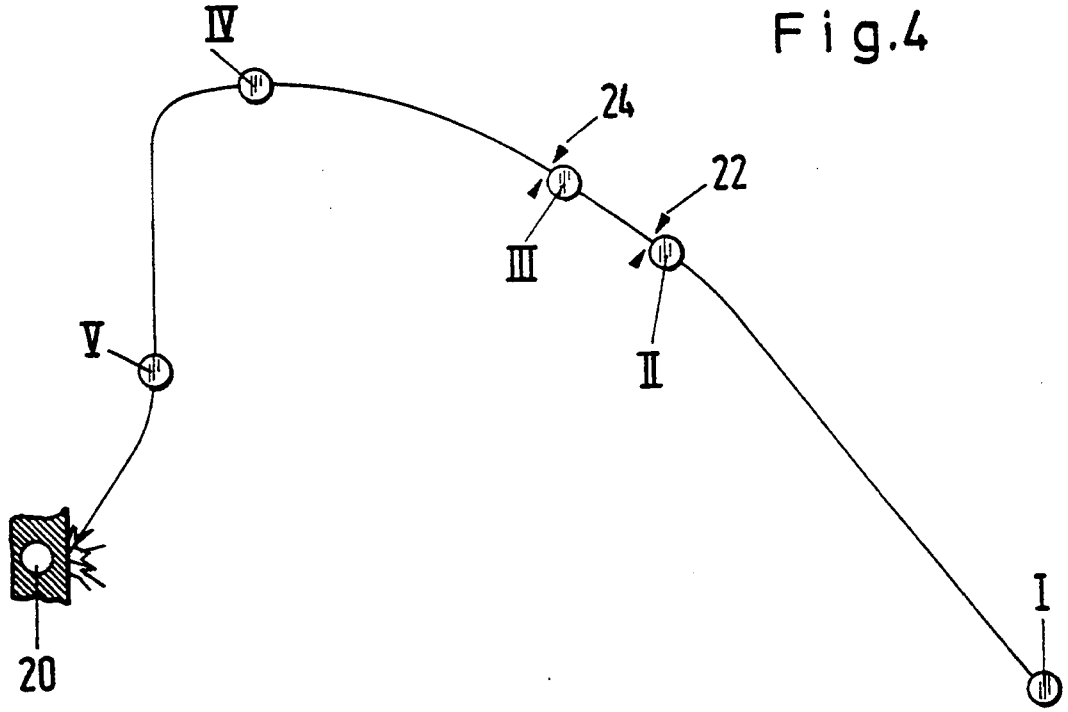
FIG. 4 correlates the flight path of the missile of the invention operated as a missile with the various stages according to FIG. 3.

FIGS. 3 and 4 show the various separation stages of the missile. The missile is started in the ground position in the non-separated condition corresponding to position I—by actuating the booster 10—and ascends in this condition, through a ballistic phase after the booster is extinguished, up to a separation level 22 (position II) in which the booster 10 is separated from the parachute section 12 by hard detachment in the manner set forth below. The remaining missile composed of the parachute section 12, the as yet unignited cruise engine 16 and the warhead 18 then continues to fly ballistically up to a separating level 24. Upon transition from position III into position IV, a separating means (described below) that connects the booster 10 to the parachute section 12 and thus to the drag chute 14, causes the drag chute 14 to open, as the booster 10 and the parachute section 12 are separated from the drag chute 14 and the remaining missile stages 16 and 18 in position IV.

After the ignition of the cruise engine 16, the detachment and deployment of the drag chute 14 ensues in position V, whereupon the target seeking missile portion, composed of the cruise engine 16 and the warhead 18, which is provided with appropriate sensors and guide devices, reaches a target 20.

The structure of the missile shall now be set forth in greater detail with reference to FIGS. 5–7.

Figure 5:
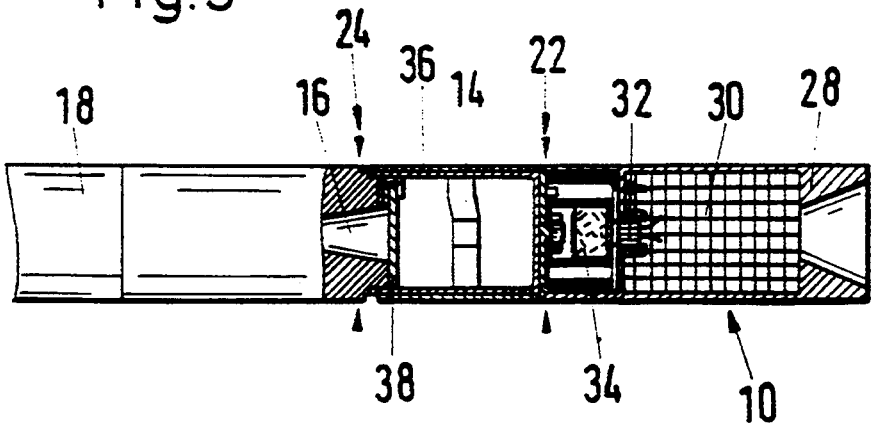
FIG. 5 shows a missile according to FIGS. 1–4 in an axial longitudinal section, whereby a part of the warhead is omitted.

As FIG. 5 shows, the booster 10 includes a booster housing 28 and a propellant 30. An ignition device 32 having a separating charge 34 is provided forward of the propellant 30 in the flight direction. The separating charge 34 is allocated to a parachute housing 36 as set forth further below, within which the parachute pot 60 is located and in which a folded drag chute 14 is contained. The parachute pot 60 is closed toward the cruise engine 16 by a cover 38. The warhead is only partially shown in FIG. 5.

Figure 6:
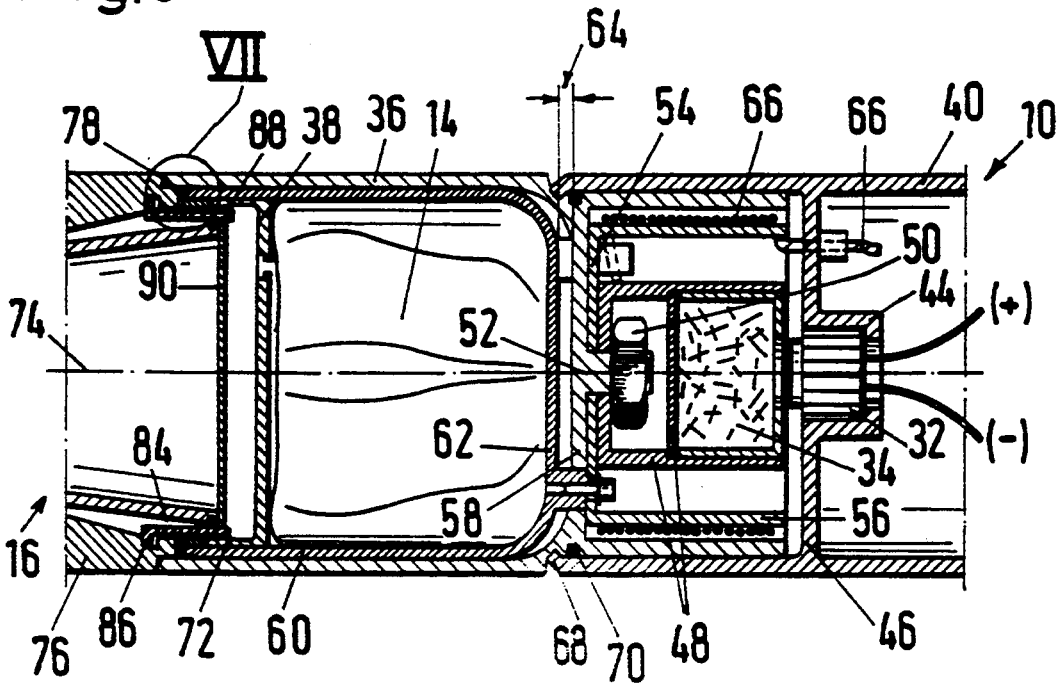
FIG. 6 shows a part of the missile of FIG. 5, likewise in an axial section through the longitudinal center axis of the missile, enlarged.

FIG. 6 shows the transition region between a jacket 40 of the booster 10, the parachute housing 36 and the cruise engine 16 in a detailed view. As may be seen, the ignition device 32 for the separating charge 34 is seated in a cage 44 that concentrically surrounds the longitudinal center axis of the jacket 40 of the booster 10 and which is fashioned in an intermediate wall 46 of the jacket 40. The separating charge 34 is arranged inside a separating charge unit 48 composed of separating charge pot, an intermediate cover and cage that is screwed with a nut 50 onto a threaded projection 52. The projection 52 slidably penetrates a base 54 of a cable drum 56 and is connected to the terminating base 58 of the parachute housing 36. The parachute pot 60 is arranged axially movable within the parachute housing 36. A free space 64 remains between the base 58 and a base 62 of the parachute pot 60 at the side of the booster.

An arrestor cable 66 is wound onto the cable drum 55, this arrestor cable 66, as may be seen from FIG. 6, having one end secured to the intermediate base 46 of the jacket 40 and having its other end secured to the base 54 of the cable drum 56. The jacket 40 is joined to the parachute housing 36 via a circumferential bead crimping 68.

The drag chute 14, whose lines are secured to the cover 38, is accommodated within the parachute pot 60. The cover 38 has a circumferential flange 72 projecting in the direction toward the cruise engine 16 with an inside surface extending from the plane of the cover 38 in the direction toward the cruise engine 16 and inclined obliquely in the direction toward the longitudinal center axis 74 of the missile. The pressured housing 36 is connected to a jacket 76 of the cruise engine 16 via a resilient connecting ring 78 having an L-shape that, as the detailed view in FIG. 7 shows, is held in a compressed position shown in FIG. 6 by the circumferential edge of the parachute pot 60. The ring 78 is disposed in an inner annular channel of the parachute housing 36 and in an outer annular channel 80 of the jacket 76. The ring 78 expands in diameter obliquely in the direction toward the booster 10. A seal element 82 seals the connection between the parachute housing 36 and the jacket 76.

A radially resilient strain ring 84 having two radially outwardly directed edge flanges 86 and 88 is pressed outwardly by a supporting cover 90 that terminates the combustion chamber of the cruise engine 16 toward the cover 38 in the stage shown in FIG. 6. The edge flange 86 engages into an inside channel of the jacket 76, whereas the edge flange 88 presses against the oblique inside surface of the circumferential flange 72 of the cover 38. The parachute housing 36 and the jacket 76 are thus connected to one another by the strain ring 84 as long as the supporting cover 90 is in the position shown in FIG. 6. Further, the parachute housing 36 and the jacket 76 are connected to one another as long as the connecting ring 78 is in the position shown in FIGS. 6 and 7 wherein it is clamped in its interlock position by the lower edge of the parachute pot 60 at the side of the cruise engine 16.

Figure 7:
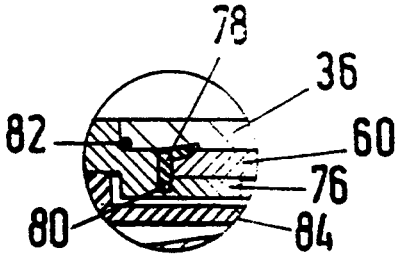
FIG. 7 shows detail VII of the missile shown in FIG. 6, enlarged compared to FIG. 6.
Figure 8:
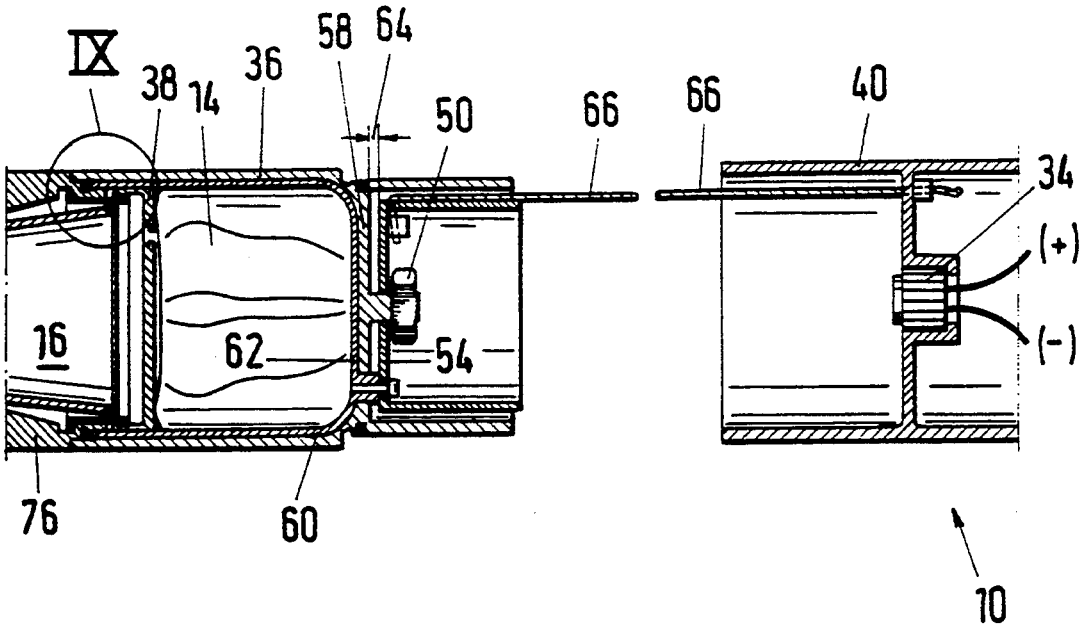
FIG. 8 shows the missile of FIG. 6 in an illustration corresponding to FIG. 6 when the booster is detached.
Figure 9:
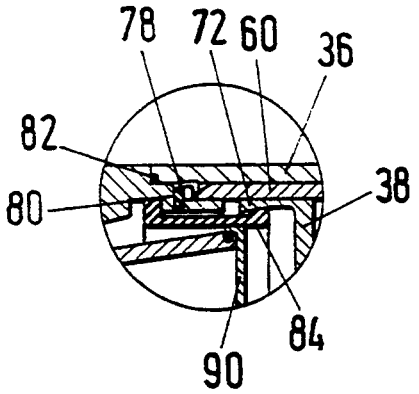
FIG. 9 shows a detail IX of the missile of FIG. 8, enlarged compared to FIG. 8.

The stage of the missile shown in FIGS. 8 and 9 differs from that according to FIGS. 6 and 7 in that the parachute pot 60 has been pulled in the direction toward the booster 10 by the tensed arrestor cable 66 while traversing the space 64, so that the wall 62 presses against the base 58. As a result the space 64 is now located between the base 58 and the cable drum base 54 at which the arrestor cable 66 engages. The connecting ring 78 has thereby been relieved by that edge of the parachute pot 60 (FIG. 9) at the side of the cruise engine 16 and no longer engages with resilient pressure into the bevelled inside channel of the parachute housing 36, but is let into the annular channel 80. As a result, i.e. in the position shown in FIG. 9, the parachute housing 36 can be pulled off of the jacket 76 by a slight axial tensile force.

Figure 10:
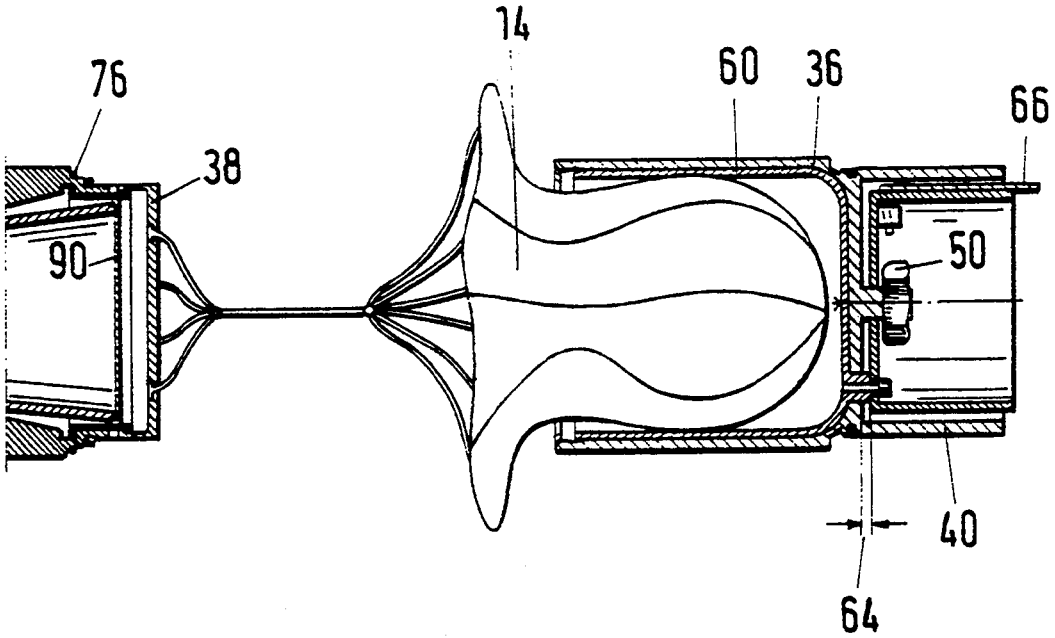
FIG. 10 shows the missile of FIGS. 1–9, enlarged and in longitudinal axial section and in a stage wherein the drag chute is just opening.

FIG. 10 shows a stage wherein the drag chute 14 is just opening, thus the parachute housing 36 has separated from the jacket 76 of the booster. The drag chute 14 with its lines secured to the cover 38 is just leaving the parachute pot 60 and the parachute housing 36 in FIG. 10.

Figure 11:
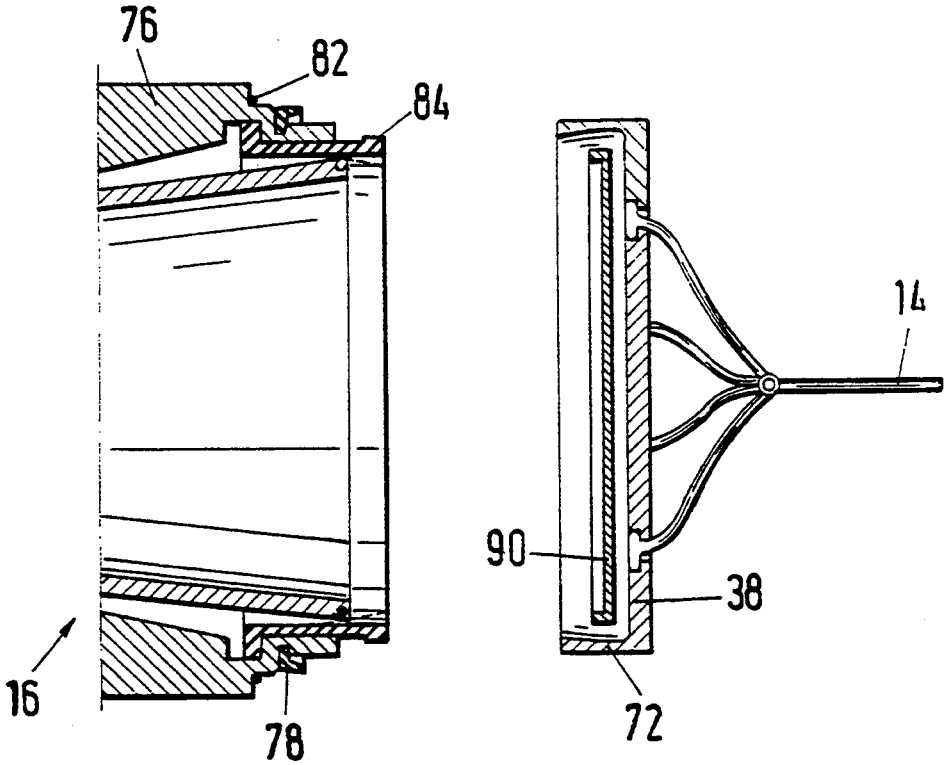
FIG. 11 shows the missile of FIGS. 1–10 with the drag chute detached from the cruise engine.

In the stage of FIG. 11, the supporting cover 90 has separated from the combustion chamber of the booster 16. As a result, the strain ring 84 has been radially relieved, so that it is capable of sliding along the conical inside surface of the circumferential flange 72 of the cover 38. The drag chute 14 together with cover 38 are thus completely separated from the booster 16.

The missile set forth above is used in the following way.

The missile is placed into flight speed by its booster 10 at the departure angle $\alpha$ from its ground position. After the end of the starting phase, a portion of which constitutes a flight path, the separating charge 34 is ignited (detonated) at an altitude above the target region with the ignition device 32 that is located at the booster 10. The quantity of gas which arises effects a hard separation of the booster 10 (more specifically, the jacket 40 thereof) from the parachute housing 36, whereby the connection between the jacket 40 and the parachute housing 36 produced by the circumferential beading 68 is undone.

As soon as the remaining missile formed of the cruise engine 16 and the warhead 18 has reached its active position above the target 20 hanging from the drag chute 14, the cruise engine 16 is ignited. The supporting cover 90 closes the combustion chamber of the cruise engine 16 until a propulsion gas pressure necessary for a stable flight of the warhead 18 has built-up in the combustion chamber of the cruise engine 16. Only then is the supporting cover 90 repelled from the combustion chamber of the cruise engine 16, whereby the strain ring 84 simultaneously relaxes. As a result, the circumferential flange 72 of the cover 38 is released by the strain ring 84, so that the drag chute 14 separates from the cruise engine 16 and the warhead 18 permanently connected thereto.

It should be noted that the stretched cable connection as a result of the arrestor cable 66, the cable tensile force of the arrestor cable 66 together with the air resistance at the booster 10, easily separates the parachute housing 36 from the connecting location to the cruise engine 16. The force of the connection has been reduced to a minimum with respect to its fastening resistance due to the relaxation of the connecting ring 78. The drag chute 14 can thereby be released into the air stream without a great exertion of force with the arrestor cable 66.

The reduction of the flight speed of the front member formed of the cruise engine 16 and the warhead 18 by the drag chute 14 from approximately 200 m/s to approximately 20 m/s requires a collision-free flight of the above-defined remaining missile composed of the cruise engine 16 and warhead 18 and the detached stern parts composed of the booster 10 and the parachute housing 36 together with the parts permanently connected thereto. The shearing or drifting of the stern parts out of the flight path of what is now the "slow" front member units 16 and 18 is primarily effected by the separation speed and is secondarily effected by the arrestor cable 66 between the booster 10 and the parachute housing 36.

The required deflection of the parts of the stern from the flight path, i.e. the booster 10 and of the parachute housing 36 connected to one another by the arrestor cable 66, arises due to instability of their combined center of gravity and due to the force moments caused by air resistance at the booster 10 and at the parachute housing 36. The relatively long-lasting opening phase ($t \approx 0.3$ seconds) of the drag chute 14 and the subsequent, slow flight of the front member composed of the cruise engine 16 and warhead 18 resulting therefrom with the opened drag chute 14 proceed undisturbed by the drift or spin of the stern part composed of the booster 10 and the parachute housing 36 from the originally common flight path. The excursion effect is causily founded in the stern part itself.

Before the rocket stage of the cruise engine 16 is ignited, the cruise engine 16 together with the warhead 18 hang from the drag chute 14 by the cover 38, and drop approximately vertically to the ground at approximately 20 m/s. The flight of the front member to the target ensues after the start of the engine of the cruise engine 16 and the above-subscribed uncoupling of the drag chute 14. It should be noted that the supporting cover 90 has a triple function, namely sealing the combustion chamber of the cruise engine 16, guaranteeing the necessary build up of the starting power in the cruise engine 16, and uncoupling the front member from the drag chute 14.

Although modifications and changes may be suggested by those skilled in the art, it is the intention of the inventors to embody within the patent warranted hereon all changes and modifications as reasonably and properly come within the scope of their contribution to the art.

We claim as our invention:

1. In a missile having, in succession from a stern of said missile along an axial direction corresponding to the missile flight direction, a booster stage, a folded drag chute, a cruise engine stage connected to said drag chute, and a payload, the improvement comprising:

a parachute pot containing said drag chute and disposed in a parachute housing between said booster stage and said cruise engine stage, said parachute housing and said parachute pot each being open at respective sides thereof facing said cruise engine stage and said parachute housing being closed by a parachute housing base facing said booster stage, said parachute pot having a size relative to an interior of said parachute housing permitting limited axial displacement of said parachute pot in said parachute housing;

first releasable connecting means for connecting said booster stage to said parachute housing and for releasing said booster stage from said parachute housing upon the application of an axial tensile force to said first releasable connecting means;

separating charge means for, upon detonation thereof, applying said axial tensile force to said first releasable connecting means for separating said booster stage from said parachute housing;

second releasable connecting means for connecting said parachute housing to said cruise engine stage and activateable by axial displacement of said parachute pot for releasing said parachute housing from said cruise engine stage;

drag chute deployment means mechanically connected between said parachute housing base and said booster stage for deploying said drag chute, after a delay following detonation of said separating charge means, by axially displacing said parachute pot and thereby also activating said second releasable connecting means to separate said parachute housing from said cruise engine stage; and third releasable connecting means for connecting said drag chute to said cruise engine stage and for releasing said drag chute from said cruise engine stage following ignition of said cruise engine stage.

2. The improvement of claim 1 wherein said separating charge means comprises an explosive charge contained in a charge pot, said charge pot having a charge pot base facing said parachute housing and being open facing said booster stage.

3. The improvement of claim 1 wherein said separating charge means and said drag chute deployment means are both connected to said parachute housing.

4. The improvement of claim 1 wherein said missile has a longitudinal center axis proceeding in said axial direction, and said improvement further comprising:

said parachute housing having a hollow-cylindrical projection disposed concentrically relative to said longitudinal center axis and being open toward said booster stage and surrounding said separating charge means and said drag chute deployment means; and said booster stage having a jacket surrounding said projection of said parachute housing.

5. The improvement of claim 1 wherein said second releasable connecting means comprises a positive locking mechanism.

6. The improvement of claim 5 wherein said cruise engine stage has an outer circumferential channel and wherein said parachute housing has an inner annular recess, and wherein said positive locking mechanism comprises said channel and said recess and an L-shaped resilient connecting ring having a first leg extending into said channel and a second leg extending into said recess, said resilient connecting ring being axially compressed against said cruise engine stage by said parachute pot and expanding obliquely outwardly in a direction toward said booster stage.

7. The improvement of claim 1 wherein said drag chute includes drag chute lines, and said improvement further comprising a cover connected to said drag chute lines and being disposed to cover an end of said cruise engine stage facing said parachute housing, said cover carrying said third releasable connecting means.

8. The improvement of claim 7 wherein said third releasable connecting means comprises a resilient strain ring having first retainer means for releasably holding said cover and second retainer means for releasably attaching to said cruise engine stage, and said third releasable connecting means further including means for closing a propulsion gas exit opening of said cruise engine stage and for pressing said resilient strain ring radially outwardly into a locked position until a predetermined propulsion gas pressure is built-up by said cruise engine stage after ignition of said cruise engine stage.

9. The improvement of claim 8 wherein said cover has an inner circumferential surface slanted obliquely radially inwardly in a direction toward said cruise engine stage, and wherein said cover has an outer cylindrical, circumferential surface accepted axially slidably in said parachute pot, and wherein said first retainer means comprises a radially outwardly extending end flange of said resilient strain ring which presses against said inner circumferential surface of said cover.

10. The improvement of claim 8 wherein said second retainer means comprises a radially outwardly extending flange of said resilient strain ring engaging in an inner annular channel of said cruise engine stage.

11. The improvement of claim 1 wherein said drag chute deployment means comprises an arrestor cable having a first end attached to said booster stage and a second end attached to said parachute housing base.

12. The improvement of claim 11 wherein said drag chute deployment means further comprises a cable drum around which said arrestor cable is wound, and from which said arrestor cable is unwound during said delay.

13. The improvement of claim 12 wherein said cable drum has a circumferential surface, and wherein said circumferential surface of said cable drum is disposed parallel to said axial direction.

14. The improvement of claim 13 wherein said missile has a longitudinal center axis extending in said axial direction, and wherein said cable drum is disposed coaxially relative to said center axis of said missile.

15. The improvement of claim 13 wherein said separating charge means comprises an explosive charge contained in a charge pot, said charge pot having a charge pot base facing said parachute housing and being open facing said booster stage.

16. The improvement of claim 15 wherein said circumferential surface of said cable drum concentrically surrounds said charge pot.

* * * * *